United States Patent [19]

Allenbaugh

[11] Patent Number: 4,673,204

[45] Date of Patent: Jun. 16, 1987

[54] INTERLOCKING PROTECTIVE DOOR SHIELD

[75] Inventor: Howard M. Allenbaugh, Fountain Valley, Calif.

[73] Assignee: M.A.G. Engineering & Mfg. Co., Inc., Huntington Beach, Calif.

[21] Appl. No.: 725,141

[22] Filed: Apr. 19, 1985

Related U.S. Application Data

[63] Continuation of Ser. No. 496,596, May 20, 1983, abandoned.

[51] Int. Cl.[4] ..... E05C 21/00

[52] U.S. Cl. ..... 292/346; 292/337

[58] Field of Search ..... 292/346, 340; 70/450, 70/452; 49/460, 462; 411/533, 546; 403/408, 337

[56] References Cited

U.S. PATENT DOCUMENTS

| | | | |
|---|---|---|---|
| 180,894 | 8/1876 | Leach | 70/448 |
| 963,450 | 7/1910 | Lowe | 70/450 X |
| 1,861,814 | 6/1932 | Peters | 29/526 R |
| 2,585,557 | 2/1952 | Kreimendahl | 29/526 R |
| 3,305,995 | 2/1967 | Armstrong et al. | 403/408 X |
| 3,666,309 | 5/1972 | Zarzycki | 292/337 |
| 3,673,605 | 6/1972 | Allenbaugh | 292/346 |
| 3,934,910 | 1/1976 | Radke | 292/346 |
| 4,139,999 | 2/1979 | Allenbaugh . | |
| 4,141,234 | 2/1979 | Hoos | 70/450 |
| 4,161,059 | 7/1979 | Francois | 403/408 X |
| 4,189,176 | 2/1980 | Hamilton | 292/346 |
| 4,397,168 | 8/1983 | Rotondi et al. | 70/452 X |
| 4,498,694 | 2/1985 | Warwick | 292/337 |

*Primary Examiner*—Richard E. Moore

*Attorney, Agent, or Firm*—Pretty, Schroeder, Brueggemann & Clark

[57] ABSTRACT

A generally U-shaped protective door shield that engages the swingable edge of a door defines a bolt opening that is to be aligned with a bolt aperture of an underlying face plate of a bolt or lock mechanism. Common anchoring screws are driven through the shield and the face plate into the door, forming a single integral structure of increased strength and insuring proper alignment. Preferably the face plate has recessed screw holes that receive lips on the shield. These lips may be deformed into the recesses by the anchoring screws.

4 Claims, 7 Drawing Figures

INTERLOCKING PROTECTIVE DOOR SHIELD

This application is a continuation of application Ser. No. 496,596, filed May 20, 1983, now abandoned.

FIELD OF THE INVENTION

The present invention relates to protective door shields for use in combination with a lock mounted in the swingable edge of a door, and it relates to a method for installing such a shield.

BACKGROUND OF THE INVENTION

Lock and latch mechanisms of the types conventionally installed in the swingable edge of a door typically weaken the door substantially in precisely the area where the strength of the door is most critical. Thus, many doors can be opened by the force of a kick even though secured by a strong lock. To strengthen the door in the area of the lock, it is known to employ a U-shaped protective shield that fits over the edge of the door in the area of the lock. Exemplary shields of that type are described in the present inventor's U.S. Pat. Nos. 3,673,605 and 4,139,999. Shields of this type typically have a relatively large apperture to accommodate the lock or latch bolt and are secured to the door independently of the lock or latch by screws.

While known protective shields are a significant improvement over doors without such shields, there is a need for more effective shields that are more easily installed and lend greater added strength to the door.

SUMMARY OF THE INVENTION

The above objectives are accomplished by a generally U-shaped protective door shield having a center section and two integrally formed parallel side panels. The center section defines an opening for passage of a bolt of the lock or latch, a bolt opening of the shield being aligned with the apperture of the face plate.

The shield has two screw holes that are aligned with screw holes in the face plate and a pair of anchor screws passing through the holes into the door. Lips carried by the face plate project into recesses surrounding the face plate screw holes, thus interlocking the shield and the mechanism with the door as a single integral structure.

According to one embodiment of the invention, the shield has circular malleable lips that overlie the face plate holes. The anchoring screws deform the lips forcing them into recesses in the face plate. Preferably, the recesses of the face plate are conical, having diameters that decrease from the outer surface to facilitate such an interlock.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

An exemplary door shield 10 that embodies the novel features of the present invention is illustrated in FIGS. 1–5 of the accompanying drawings. This shield 10 is U-shaped to engage the swingable edge 12 of a door 14 in the region of a conventional lock or latch mechanism 16, in this case a mortise lock.

Figure 1:
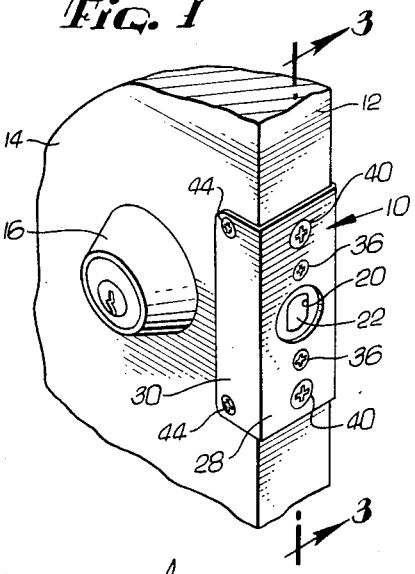
FIG. 1 is a perspective, pictorial view of a door shield in accordance with the invention installed on the swingable edge of a door.
Figure 2:
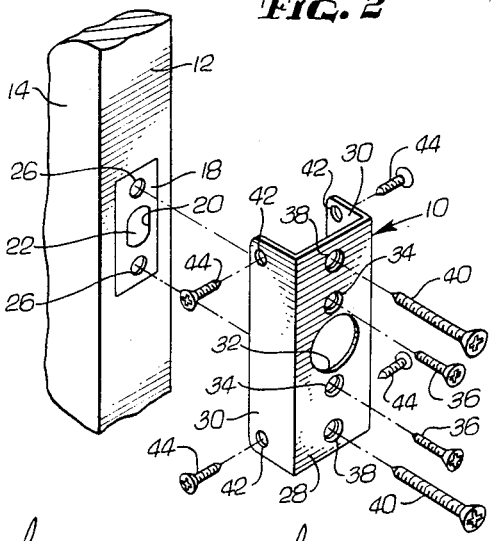
FIG. 2 is an exploded view of the shield and door of FIG. 1.
Figure 3:
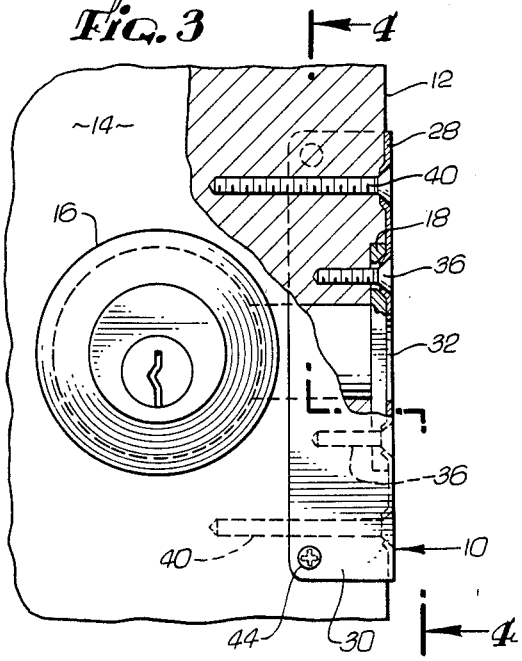
FIG. 3 is a partially broken-away side elevation of the shield and door showing a lock mechanism in combination with the shield.
Figure 4:
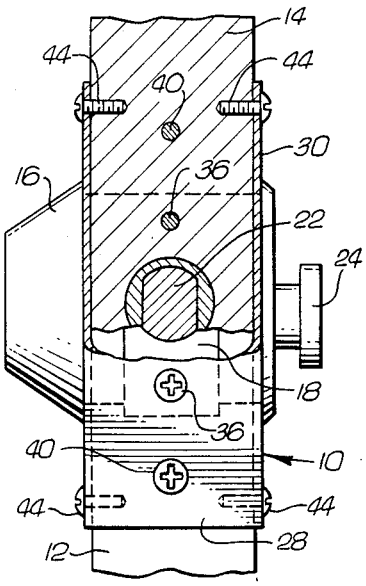
FIG. 4 is a partially broken-away end view of the combination of FIG. 3 taken along the line 3—3.

The lock 16 is recessed within the door 14 and includes a rectangular face plate 18 that is flush with the swingable edge 12 (FIG. 2). The face plate 18 defines a centered bolt apperture 20 through which a bolt 22 can move slidably between (1) a locked position in which the bolt projects through the apperture beyond the edge 12 of the door 14 and (2) an unlocked position in which the bolt is retracted within the door such that its outer end is flush with the edge (as best shown in FIGS. 1 and 3). Movement of the bolt 22 between the locked and the unlocked positions is accomplished in the conventional manner by turning a key or a knob 24 (FIG. 4).

The face plate 18 also defines two counter-sunk face plate screw holes 26, thereby forming conical recesses for receiving screws that can be used to secure the lock mechanism 16 to the edge of the door 14 in the conventional manner without the shield 10. Each recess has its largest diameter at the outer surface of the face plate 18 and its smallest diameter at the inner surface. The screw holes 26 are located on opposite sides of the bolt apperture 20, one above and one below.

The shield 10 is stamped from a single steel sheet. It comprises a vertically elongated rectangular center section 28 and two generally rectangular side panels 30 integrally formed with the center section and extending perpendicular thereto. The shield 10 is dimensioned to fit snugly about the edge 12 of the door 14 with the center section 28 overlying the face plate 18 and with the side panels 30 overlying portions of the inner and outer door surfaces on either side of the lock 16. The center section 28 has a larger surface area than the underlying face plate 18, and, when the shield 10 is installed on the door 14, portions of the center section extend beyond the upper and lower edges of the face plate and directly overlie the edge 12 of the door.

The center section 28 defines a circular bolt opening 32 at its center to permit passage of the bolt 22 as it extends through the bolt apperture 20 of the face plate to the locked position. The center section 28 also defines two shield screw holes 34 for receiving a pair of attachment screws 36. These holes 34 are located on opposite sides of the bolt apperture 20, one above and one below. They are positioned to permit alignment of the shield screw holes 34 with the face plate screw holes 26. Thus, when the shield 10 engages the edge 12 of the door 14, the anchor screws 36 secure the shield 10 and the face plate 18 to the door, forming a strong, unitary, integral structure.

The center section 28 of the shield 10 also defines two additional screw holes 38 located on opposite sides of its bolt 22 with the bolt opening 32 and the shield screw holes 34 between them. These additional screw holes 38 are formed in the upper and lower portions of the center section 28 which extend beyond the face plate 18 and directly overlie the edge 12 of the door 14. Relatively long anchor screws 40 inserted in the additional screw holes 38 are driven into the door 14 to reinforce the attachment of the shield 10.

Each side panel 30 of the shield 10 also defines two side screw holes 42 for receiving relatively short side screws 44. The side screw holes 42 are formed near the corners of the side panels 30 which are most distant from the door edge 12 when the shield 10 is in place.

Figure 5:
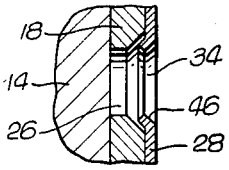
FIG. 5 is a cross-sectional side view taken through one of the screw holes.

As best illustrated in FIG. 5, each shield screw hole 34 that receives an anchoring screw 36 is surrounded by a conical, circular peripheral lip 46 that is angled inwardly toward the face plate 18. The lip 46 extends about the recessed face plate screw holes when the shield 10 is positioned on the door 14 and the shield screw holes 34 and face plate screw holes 26 are aligned.

As shown in FIG. 3, when the anchoring screws 36 are driven into the edge 12 of the door 14, the conical heads of the screws, which have a larger diameter than the attachment screw holes, fit into the lips 46 and secure the lips 46 inwardly against the outer perimeters of the face plate screw holes 26. The heads of the screws 36 are flushed with the outer surface of the face plate 18. An interlocking fit is thereby produced between the shield 10 and the face plate 18, enhancing the protective function of the shield, preventing lateral and vertical movement between the shield and the door 14 and forming a unitary, integral structure of greatly increased strength.

Figure 6:
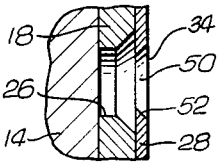
FIGS. 6 and 7 are fragmentary views similar to FIG. 5 showing a second embodiment of the shield before and after an anchoring screw has been installed.
Figure 7:
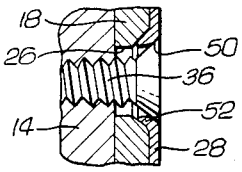

In an alternate embodiment depicted in FIGS. 6 and 7, shield screw holes 50 for the anchor screws 36 have diameters smaller than the diameters of the recessed or counter-sunk regions surrounding the face plate screw holes 26. The inner perimeters of the primary shield screw holes 50 are conically tapered such that the diameters of the holes decrease from the outer surface of the center section 28 to the inner surface. Portions of the center section 28 immediately adjacent to the primary shield screw holes 50 thus form tapered lips 52 which overly portions of the recesses around the face plate screw holes 26 when the shield 10 engages the swingable edge 12 of the door 14 and the screw holes 26 and 34 are aligned. The lips 52 do not, however, project into the recesses surrounding the holes 26.

As illustrated in FIG. 7, when an anchor screw 26 is inserted in the aligned screw holes 26 and 34 and driven into the door 14, the head of the screw, which has a larger diameter than the primary shield screw hole 50, deforms the lip 52 and forces it into the underlying counter-sunk face plate screw hole 26. The lip 52 is thus deformed inwardly against the outer perimeter of the face plate screw hole 26 to produce an interlocking fit like that discussed above in connection with FIG. 5.

It will be appreciated from the description above that the present invention provides a highly effective door shield of unitary, integral construction that can be installed with a minimum of effort but has a maximum strengthening effect. The use of common anchor screws for the shield and lock adds strength by structurally interlocking the shield and the lock or latch mechanism 16. Misalignment of the bolt opening 32 of the shield 10 relative to the bolt apperture 20 of the face plate 18 is impossible because of these common screws. Moreover, the common screws can be installed first to accurately position the shield 10 and the other screws 36 and 44 can be installed afterward. The time and care required for installation is thus significantly reduced.

While particular forms of the invention have been illustrated and described, it will be apparent that various modifications can be made without departing from the spirit and scope of the invention.

I claim:

1. An improved door shield for use in combination with a lock or latch mechanism mounted in the swingable edge of a door and retained by anchor screws, said mechanism having a face plate defining a bolt aperture that fits flush with said edge and a bolt slidable between (1) a locked position in which said bolt projects through said aperture and (2) an unlocked position in which said bolt is retracted within said door, said face plate defining at least two face plate screw holes for receiving said anchor screws to secure said face plate to said door, and countersunk recesses surrounding said holes, said shield being generally U-shaped and comprising:

a center section; and two parallel side panels integrally formed with said center section and extending perpendicularly thereto, said shield being thus adapted to overlie said face plate and to snugly engage said edge in the region of said mechanism with said side panels overlying opposite sides of the door;

said center section defining an opening for passage of said bolt, at least two shield screw holes for alignment with said face plate screw holes, perimeter portions of said center section surrounding said shield screw holes forming malleable circular lips which at least partially overlie said recesses when said shield screw holes and said face plate screw holes are aligned, said lips being tapered such that the diameters of said screw holes decrease from a relatively large diameter adjacent to the outer surface of said center section to a relatively small diameter adjacent to the inner surface of said center section, whereby said lips can be deformed conically into said countersunk face plate screw holes and thus forced into said face plate screw holes to interlock said shield and said face plate.

2. A door shield as setforth in claim 1, wherein said center section defines two additional screw holes located on opposite sides of said bolt opening, said additional screw holes being formed in portions of said center section which extend beyond said face plate and which directly overlie said swingable door edge when said shield is installed on said edge, whereby additional screws can be inserted into said additional screw holes and driven into said door to reinforce the attachment of said metal plate to said door.

3. A combination comprising:

a door having a swingable edge;

a lock or latch mechanism mounted in the swingable edge of said door, said mechanism having a face plate defining a bolt aperture that fits flush with said edge and a bolt slidable between (1) a locked position in which said bolt projects through said aperture and (2) an unlocked position in which said bolt is retracted within said door, said face plate further defining at least two face plate screw holes for receiving anchor screws to secure said face plate to said door and counter-sunk recesses of conical cross-section surrounding said holes;

at least two screws having heads with conical back surfaces for securing said mechanism and said shield to said door; and a shield that is generally U-shaped having:

(a) a center section, and (b) two parallel side panels extending perpendicularly thereto, said shield being thus adapted to overlie said face plate and to snugly engage said edge in the region of said mechanism with said side panels overlying opposite sides of said door, (c) said center section defining an opening for passage of said bolt and at least two shield screw holes aligned with said face plate screw holes, said holes being surrounded by conical lips that extend into said recesses whereby said lips overly said conical recesses, said screws being inserted in said shield screw holes and said face plate screw holes in threaded engagement with said door and thereby pulling said conical surfaces of said lips into firm engagement with said conical surfaces of said recesses, thus forming a single, integral structure of said door, mechanism and shield.

4. A combination comprising:

a door having a swingable edge;

a lock or latch mechanism mounted in the swingable edge of said door, said mechanism having a face plate defining a bolt aperture that fits flush with said edge and a bolt slidable between (1) a locked position in which said bolt projects throught said aperture and (2) an unlocked position in which said bolt is retracted within said door, said face plate further defining at least two face plate screw holes for receiving anchor screws to secure said face plate to said door and counter-sunk recesses of conical cross-section surrounding said holes;

at least two screws having heads with conical back surfaces for securing said mechanism and said shield to said door; and a shield that is generally U-shaped having:

(a) a center section, and (b) two parallel side panels extending perpendicularly thereto, said shield being thus adapted to overlie said face plate and to snugly engage said edge in the region of said mechanism with said side panels overlying opposite sides of said door, (c) said center section defining an opening for passage of said bolt and at least two shield screw holes aligned with said face plate screw holes, said holes being surrounded by tapered conical lips that extend into said recesses whereby said lips overly said conical recesses, said screws being inserted in said shield screw holes and said face plate screw holes in engagement with said door and thereby pressing said conical surfaces of said lips into firm engagement with said conical surfaces of said recesses, thus forming a single, integral structure of said door, mechanism and shield.

* * * * *